United States Patent [19]

Yirmiyahu et al.

[11] Patent Number: 4,909,062

[45] Date of Patent: Mar. 20, 1990

[54] FORCE-APPLYING TOOL PARTICULARLY USEFUL FOR FORCE-OPENING WINDOW GRILLE BARS

[76] Inventors: Mordechai Yirmiyahu, Ancio Sereni Street 17, Givatayim; Benyamin Yirmiyahu, Naimon Street 52, Bnei Brak, both of Israel

[21] Appl. No.: 329,602

[22] Filed: Mar. 28, 1989

[30] Foreign Application Priority Data

Dec. 10, 1986 [IL] Israel ..... 80926

[51] Int. Cl.[4] ..... B66F 3/24

[52] U.S. Cl. ..... 72/392; 254/93 R

[58] Field of Search ..... 72/392, 705; 254/93 R

[56] References Cited

U.S. PATENT DOCUMENTS

| | | | |
|---|---|---|---|
| 2,135,278 | 11/1938 | Countryman | 72/392 |
| 2,444,250 | 6/1948 | Ferguson | 72/705 |
| 2,546,203 | 3/1951 | Tucker | 254/93 R |
| 2,790,426 | 4/1957 | Mueller | 254/93 R |
| 3,081,066 | 3/1963 | Murawski | 254/93 R |
| 3,765,219 | 10/1973 | Easom | 72/705 |

*Primary Examiner*—Robert L. Spruill

*Attorney, Agent, or Firm*—Benjamin J. Barish

[57] ABSTRACT

A force-applying tool particularly useful for force-opening window grill bars, comprises a cylinder carrying a first jaw, a piston movable within the cylinder and including a rod carrying a second jaw, a fluid pumping device for pumping fluid to the cylinder to apply a force between the piston and cylinder tending to spread apart the first and second jaws, and a pivotable coupling between the fluid pumping device and the cylinder and piston rod permitting the fluid pumping device to bring its longitudinal axis either parallel to or perpendicular to the longitudinal axis of the cylinder and piston rod. The pivotable coupling includes a fluid passageway therethrough from the fluid pumping device to the interior of the cylinder in both of the pivotable positions of the fluid pumping device.

20 Claims, 2 Drawing Sheets

FIG. 3
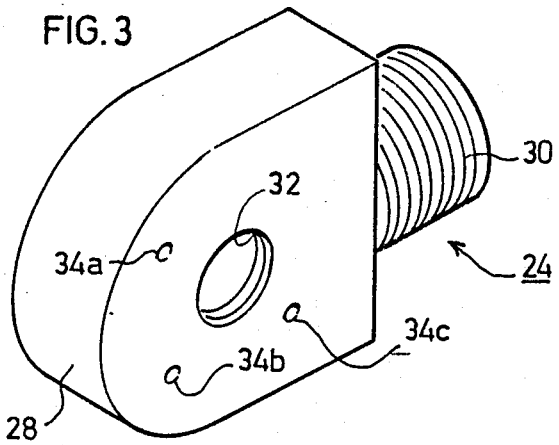
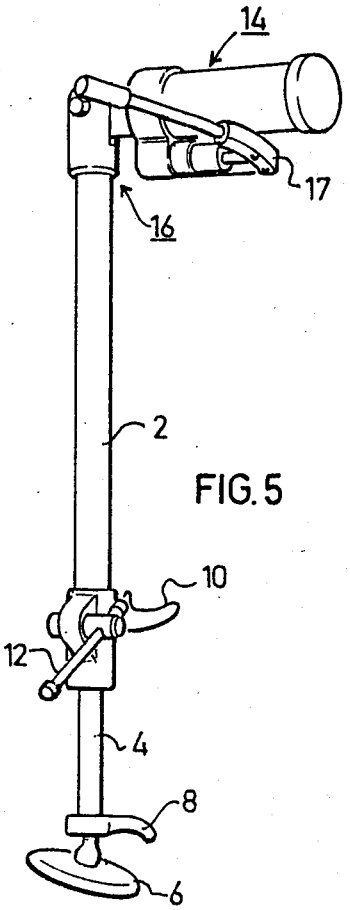
FIG. 5
FIG. 4
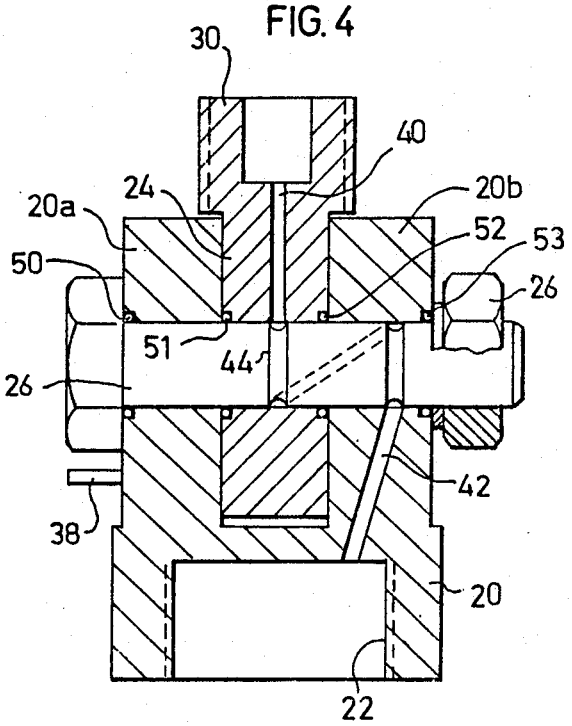

FORCE-APPLYING TOOL PARTICULARLY USEFUL FOR FORCE-OPENING WINDOW GRILLE BARS

BACKGROUND OF THE INVENTION

The present invention relates to force-applying tools for applying large forces between two objects or between two parts of an object. The invention is particularly useful as a tool for force-opening window grill bars, and is therefore described below with respect to this application, but it will be appreciated that the invention could be used in other applications as well.

There are occasions when it is necessary to apply a force between two objects, or between two parts of the same object, e.g., in order to move the two objects apart or to break whatever is holding together the two parts of the object. One such occasion is to force-open window grill bars by the fire department, police department, an anti-terrorist unit, or a rescue squad, in order to gain entry into a building structure. Today this is usually done by brute-force, e.g., by sawing, cutting or using a sledge hammer or the like to break through the window grill bars. However, such a technique is accompanied by very loud noises which is not always desirable particularly where entry into the building is being made by the police department or an anti-terrorist group.

An object of the present invention is to provide a force-applying tool which is particularly useful for force-opening window grill bars, but which may be used in many other applications as well requiring the application of a large force between two objects or between two parts of the same object.

BRIEF SUMMARY OF THE INVENTION

According to the present invention, there is provided a force-applying tool particularly useful for force-opening window grill bars, comprising a cylinder carrying a first jaw; a piston movable within the cylinder and including a rod carrying a second jaw; a fluid pumping device for pumping fluid to the cylinder to apply a force between the piston and cylinder tending to spread apart the first and second jaws; and a pivotable coupling between the fluid pumping device and the cylinder and piston rod permitting the fluid pumping device to bring its longtidudinal axis either parallel to or perpendicular to the longitudinal axis of the cylinder and piston rod. The pivotable coupling includes a fluid passageway therethrough from the fluid pumping device to the interior of the cylinder in both of the pivotable positions of the fluid pumping device.

In the preferred embodiment of the invention described below, the pivotable coupling permits the fluid pumping device to be pivoted 180° with respect to the cylinder longitudinal axis, from positions wherein the longitudinal axis of the fluid pumping device is at a right angle to the longitudinal axis of the cylinder on opposite sides of the cylinder More particularly, in the described preferred embodiment, the pivotable coupling comprises a first connector member secured to the cylinder or piston rod, and a second connector member secured to the fluid pumping device; one of the connector members being bifurcated, and the other connector member being an intermediate member pivotably mounted between the bifurcations of the bifurcated member.

According to further features included in the described preferred embodiment, the intermediate connector member is a solid block having a semi-circular configuration at one end permitting the fluid pumping device to be pivoted 180° with respect to the longitudinal axis of the cylinder; in addition, the intermediate connector member is pivotably mounted to the bifurcated member by a pivot pin passing through the two connector members; each of the connector members being formed with a fluid passageway therethrough, and the pivot pin being formed with an annular recess establishing communication between the fluid passageways in the all the pivoted positions of the two connector members.

According to a still further feature in the described preferred embodiment, the bifurcations of the bifurcated connector member are formed with a pair of aligned openings, an the intermediate connector member is formed with three spaced openings each alignable with the pair of aligned openings in the three pivotable positions of the intermediate connector member with respect to the bifurcated connector member; the tool further includes a locking pin receivable in the aligned openings of the two connector members to lock them in a selected pivoted position.

In the described preferred embodiment, the fluid pumping device includes a pivotable handle for manually pumping the fluid from the fluid pumping device to the interior of the cylinder. The fluid pumping device conventionally used in fluid jacks for raising automobiles is one example of a device that could be used for this purpose.

It will be seen that a tool constructed in accordance with the foregoing features of the present invention may be conveniently adapted for use in situations and applications, particularly for force-opening window grill bars, because of the pivotable mounting of the fluid pumping device.

Further features and advantages of the invention will be apparent from the description below.

BRIEF DESCRIPTION OF THE DRAWINGS

The invention is herein described, by way of example only, with reference to the accompanying drawings wherein:

FIG. 3 is a three-dimensional view more particularly illustrating the intermediate connector member in the pivotable coupling of FIG. 2;

FIG. 4 is transverse sectional view more particularly illustrating the construction of the pivotable coupling of FIG. 2; and FIG. 5. illustrates the tool of FIG. 1 with the fluid pumping device pivoted so as to extend perpendicularly to the axis of the cylinder in order to adapt it for use in a particular application, for example force-opening window grill bars.

DESCRIPTION OF A PREFERRED EMBODIMENT

Figure 1:
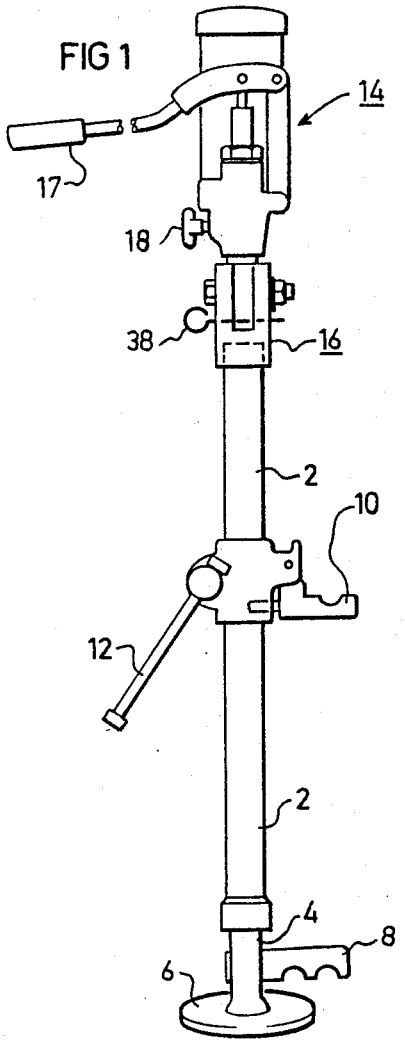
FIG. 1 illustrates one form of force-applying tool constructed in accordance with the present invention.

The tool illustrated in FIG. 1 comprises a cylinder 2 and a piston movable within the cylinder and having a rod 4 projecting through the open end of the cylinder. A base plate 6 is secured to the bottom of piston rod 4 in order to stably support the tool on a horizontal surface, for example when the tool is to be used as a conventional jack for lifting a weight such as an automobile. A first jaw 8 is rigidly secured to the piston rod 4. A second jaw 10 is carried by cylinder 2 and is movable to any desired location along the cylinder and then reclamped in position by a clamp including manual lever 12.

A fluid-operated pump 14 is mounted to the upper end of cylinder 2 via a pivotable coupling generally designated 16. The fluid operated pump 14 may be a conventional hydraulic pump operated by a manual lever 17 to pump fluid, e.g., oil, from the interior of the pump to the interior of cylinder 2 in order to apply a large force for effecting relative movement between cylinder 2 and piston rod 4. The fluid operated pump 14 includes a manually-turnable knob 18 for closing the oil passageway from pump 14 to cylinder 2 in order to fix the cylinder at the desired position with respect to piston rod 4.

The fluid-operated pump 14 may be of a conventional type, such as commonly used in automobile jacks, and therefore further details of its construction and operation are not set forth herein.

As indicated above, the fluid-operated pump 14 is mounted to the upper end of cylinder 2 via pivotable coupling 16. Thin coupling permits the fluid pumping device 14 to be pivoted 180°, to assume any one of three positions with respect to cylinder 2, namely: (1) a first position wherein the longitudinal axis of the fluid pumping device is parallel to that of the cylinder, as illustrated in FIG. 1; (2) a position wherein the longitudinal axis of the fluid pumping device is at a right angle to the longitudinal axis of the cylinder on one side of the cylinder, as illustrated in FIG. 5; or (3) a position wherein the longitudinal axis of the fluid pumping device is at a right angle to the longitudinal axis of the cylinder on the opposite side of the cylinder.

Figure 2:
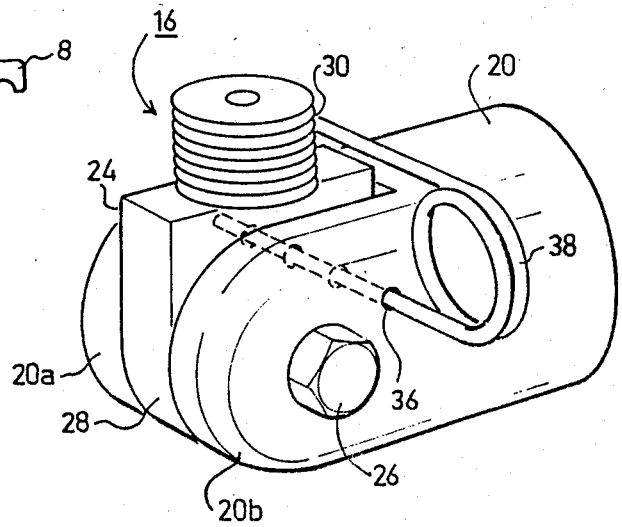
FIG. 2 is a three-dimensional view illustrating the pivotable coupling for mounting the fluid pumping device in the tool of FIG. 1.

The construction of pivotable coupling 16 is more particularly illustrated in FIGS. 2–4. It comprises a bifurcated connector member 20 formed at one end with internal threads 22 for attachment to the upper end of cylinder 2, the upper end of the cylinder being externally threaded for this purpose. The opposite end of connector member 20 is formed with two bifurcations **20*a*, 20*b*, receiving between them an intermediate connector member 24 pivotably mounted by a pin 26. Connector member 24 is in the form of a solid block having a semi-circular configuration at one end 28 permitting it to be pivoted 180° with respect to the bifurcated member 20. The opposite end of the intermediate connector member 24 is integrally formed with a stem 30 externally threaded for connection to the housing of the fluid operated device 14**, the respective end of the latter housing being internally threaded for this purpose.

The structure of the intermediate connector member 24 is more particularly illustrated in FIG. 3. It includes, i addition to the semi-circular configuration 28 at one end and the stem 30 at the opposite end, central opening 32 for receiving pivot pin 26, and three further openings **34*a*, 34*b*, 34*c* for locking this member in any one of its three pivotable positions. For this purpose, the two birfurcations 20*a*, 20*b* are formed with a pair of aligned openings 36 (FIG. 2) adapted to receive a U-shaped locking pin 38. In each of the three pivotable positions of the intermediate connector member 24, one of its openings 34*a*–34*c* is in alignment with the two openings 36 in the bifurcations 20*a*, 20*b*, thereby permitting the locking pin 38 to be passed through all the aligned openings and to lock the intermediate connector member 24** in the respective one of its three pivotable positions as described above.

As shown in FIG. 4, the intermediate connector member 24 is formed with a passageway 40 extending through it and its stem 30 for the fluid (e.g., oil) pumped from the fluid pumping device 14; and the bifurcated connector member 20 is similarly formed with a passageway 42 to conduct the fluid to the interior of cylinder 2. In the illustrated arrangement, the inlet to fluid passageway 42 is located laterally of the outlet of fluid passageway 40; in addition, the two passageways are connected together by two annular recesses 44, 46, formed in the pivot pin 26, the two annular recesses being in turn connected by an axially-extending passageway 48 formed in the pivot pin. O-rings 51-53 seal the coupling against leakage.

An alternative arrangement would be to include a single annular recess in the pivot pin 26 wide enough to communicate with the two passageways 40, 42 in all the pivotable positions of the intermediate connector member 24.

The tool illustrated in the drawings may be used as follows:

When it is to be used as a normal jack, e.g., for lifting a load, the pivotable coupling 16 would be locked in the position illustrated in FIG. 1, with the longitudinal axis of the fluid pumping device 14 aligned with the longitudinal axis of cylinder 2 and its piston rod 4. For this purpose, locking pin 38 would be received within the two aligned openings 36 in the bifurcations **20*a*, 20*b* of connector member 20, and the intermediate opening 34*b* (FIG. 3) of the intermediate connector member 24. It will be appreciated that in this position of the pivotable coupling, as well as in all its other positions, communication is established between the fluid pumping device 14 and the interior of cylinder 2 via passageways 40 and 42 (FIG. 4) through the two connector members 20, 24 of the coupling and recesses 44, 46, and 48 of the pin 26** pivotably mounting the two members together.

In such an arrangement, if the tool is to be used only as a jack for lifting purposes, only the upper jaw 10 would be operative, and this jaw may be fixed to any desired position along cylinder 2 by means of manual clamp 12. If, however, the tool is to be used for applying a force in the vertical direction between two objects, or between two parts of an object, this may be done by using both jaws 8 and 10 of the tool.

The illustrated tool is sufficiently light so that it can be supported by one person and used for many other applications, for applying a force in any direction, e.g., for force-opening window grill bars. For this application, it is preferrable to pivot the fluid-operated pump 14 so as to bring its axis 90° to the axis of cylinder 2, as shown in FIG. 5, on one or the other side of the cylinder axis, whichever is more convenient as the case may be. For this purpose, locking pin 38 is withdrawn, the fluid pumping device 14 is pivoted to the desired position to bring the appropriate one of its openings **34*a*, 34*c* (FIG. 3) in alignment with the two openings 36 in the bifurcated member 20, and then the locking pin 38 is then inserted through the aligned openings to thereby lock the fluid pumping device 14 in the desired perpendicular position as illustrated in FIG. 5. Hand lever 17 of the fluid pumping device 14 may then be manually operated in order to pump the fluid via the above-described passageways 40, 42 and recesses 44, 46, 48**

(FIG. 4) into the interior of cylinder 2, so as to move with great force jaw 10 carried by cylinder 2, with respect to jaw 8 carried by piston rod 4.

While the invention has been described with respect to one preferred embodiment, it will be appreciated that many variations and modifications may be made. For example, instead of using a hydraulic pumping device 14, pneumatic devices may be used; and instead of using a manual drive, an electrical drive may be used. Many other variations, modifications and applications of the invention will be apparent.

What is claimed is:

1. A force-applying tool particularly useful for force-opening window grill bars, comprising:

a cylinder carrying a first jaw;

a piston movable within said cylinder and including a rod carrying a second jaw;

a fluid pumping device for pumping fluid to said cylinder to apply a force between said piston and cylinder tending to spread apart said first and second jaws;

and a pivotable coupling between said fluid pumping device and said cylinder and piston rod permitting the fluid pumping device to bring its longitudinal axis either parallel to or perpendicular to the longitudinal axis of said cylinder and piston rod;

said pivotable coupling including a fluid passageway therethrough from the fluid pumping device to tee interior of said cylinder in both of said pivotable positions of the fluid pumping device.

2. The tool according to claim 1, wherein said pivotable coupling permits said fluid pumping device to be pivoted 180° with respect to said cylinder longitudinal axis from positions wherein the longitudinal axis of the fluid pumping device is at a right angle to the longitudinal axis of the cylinder on opposite sides of the cylinder.

3. The tool according to claim 2, wherein said pivotable coupling comprises a first connector member secured to said cylinder or piston rod, and a second connector member secured to said fluid pumping device; one of said connector members being bifurcated, and the other connector member being an intermediate member pivotably mounted between the bifurcations of the bifurcated member.

4. The tool according to claim 3, wherein the birfurcated connector member is secured to the cylinder, and the intermediate connector member is secured to the fluid pumping device.

5. The tool according to claim 4, wherein said bifurcated connector member is formed with internal threads at one end for securing it to the cylinder, and said intermediate connector member is formed with external threads for securing it to the fluid pumping device.

6. The tool according to claim 3, wherein said intermediate connecting member is a solid block having a semi-circular configuration at one end permitting the fluid pumping device to be pivoted 180° with respect to the longitudinal axis of the cylinder.

7. The tool according to claim 3, wherein said two connector members are pivotably mounted to each other by a pivot pin passing through the two bifurcations of the bifurcated connector member and the intermediate connector member inbetween; each of said connector members being formed with a fluid passageway therethrough, and said pivot pin being formed with an annular recess establishing communication between said fluid passageways in the all the pivoted positions of the two connector members.

8. The tool according to claim 3, wherein the bifurcations of the bifurcated connector member are formed with a pair of aligned openings, and said intermediate connector member is formed with three spaced openings each alignable with said pair of aligned openings in the three pivotable positions of the intermediate connector member with respect to the bifurcated connector member; said tool further including a locking pin receivable in aligned openings of said two connector members to lock them in a selected pivoted position.

9. The tool according to claim 1, wherein said fluid pumping device includes a pivotable handle for manually pumping the fluid from the fluid pumping device to the interior of the cylinder.

10. The tool according to claim 1, further including a clamp for clamping said first jaw in any desired position on said cylinder.

11. A force-applying tool particularly useful for force-opening window grill bars, comprising:

a cylinder carrying a first jaw;

a piston movable within said cylinder and including a rod carrying a second jaw;

a fluid pumping device for pumping fluid to said cylinder to apply a force between said piston and cylinder tending to spread apart said first and second jaws;

and a pivotable coupling between said fluid pumping device and said cylinder and piston rod permitting the fluid pumping device to bring its longitudinal axis either parallel to or perpendicular to the longitudinal axis of said cylinder and piston rod;

said pivotable coupling comprising a first connector member secured to said cylinder or piston rod, and a second connector member secured to said fluid pumping device;

one of said connector members being bifurcated, and the other connector member being an intermediate member pivotably mounted between the bifurcations of the bifurcated member.

12. The tool according to claim 11, wherein said pivotable coupling includes a fluid passageway therethrough from the fluid pumping device to the interior of said cylinder in both of said pivotable positions of the fluid pumping device.

13. The tool according to claim 11, wherein said pivotable coupling permits said fluid pumping device to be pivoted 180° with respect to said cylinder longitudinal axis from positions wherein the longitudinal axis of the fluid pumping device is at a right angle to the longitudinal axis of the cylinder on opposite sides of the cylinder.

14. The tool according to claim 11, wherein the birfurcated connector member is secured to the cylinder, and the intermediate connector member is secured to the fluid pumping device.

15. The tool according to claim 14, wherein said bifurcated connector member is formed with internal threads at one end for securing it to the cylinder, and said intermediate connector member is formed with external threads for securing it to the fluid pumping device.

16. The tool according to claim 11, wherein said intermediate connecting member is a solid block having a semi-circular configuration at one end permitting the fluid pumping device to be pivoted 180° with respect to the longitudinal axis of the cylinder.

17. The tool according to claim 11, wherein said two connector members are pivotably mounted to each other by a pivot pin passing through the two bifurcations of the bifurcated connector member and the intermediate connector member inbetween; each of said connector members being formed with a fluid passageway therethrough, and said pivot pin being formed with an annular recess establishing communication between said fluid passageways in the all the pivoted positions of the two connector members.

18. The tool according to claim 11, wherein the bifurcations of the bifurcated connector member are formed with a pair of aligned openings, and said intermediate connector member is formed with three spaced openings each alignable with said pair of aligned openings in the three pivotable positions of the intermediate connector member with respect to the bifurcated connector member; said tool further including a locking pin receivable in aligned openings of said two connector members to lock them in a selected pivoted position.

19. The tool according to claim 11, wherein said fluid pumping device includes a pivotable handle for manually pumping the fluid from the fluid pumping device to the interior of the cylinder.

20. The tool according to claim 11, further including a clamp for clamping said first jaw in any desired position on said cylinder

* * * * *